US007967637B2

(12) United States Patent
Fedder et al.

(10) Patent No.: US 7,967,637 B2
(45) Date of Patent: Jun. 28, 2011

(54) ELECTRICAL CONNECTOR SYSTEM

(75) Inventors: James Lee Fedder, Etters, PA (US); John Edward Knaub, Etters, PA (US); Peter Clark O'Donnell, Dillsburg, PA (US); Lynn Robert Sipe, Mifflintown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/641,904

(22) Filed: Dec. 18, 2009

(65) Prior Publication Data

US 2010/0144176 A1 Jun. 10, 2010

Related U.S. Application Data

(63) Continuation-in-part of application No. 12/474,605, filed on May 29, 2009, now Pat. No. 7,819,697.

(60) Provisional application No. 61/200,955, filed on Dec. 5, 2008, provisional application No. 61/205,194, filed on Jan. 16, 2009.

(51) Int. Cl.
*H01R 13/648* (2006.01)

(52) U.S. Cl. ..... 439/607.06; 439/108

(58) Field of Classification Search ..... 439/607.06, 439/607.07, 507–514, 931, 108
See application file for complete search history.

(56) References Cited

U.S. PATENT DOCUMENTS

| | | | | |
|---|---|---|---|---|
| 5,882,227 | A | 3/1999 | Neidich | |
| 6,506,076 | B2 | 1/2003 | Cohen et al. | |
| 6,676,450 | B2 | 1/2004 | Schroll | |
| 6,709,294 | B1 | 3/2004 | Cohen et al. | |
| 6,899,566 | B2 | 5/2005 | Kline et al. | |
| 6,932,626 | B2 | 8/2005 | Costello et al. | |
| 7,018,239 | B2 * | 3/2006 | Zaderej et al. | 439/607.36 |
| 7,163,421 | B1 | 1/2007 | Cohen et al. | |
| 7,207,807 | B2 | 4/2007 | Fogg | |
| 7,217,889 | B1 | 5/2007 | Parameswaran et al. | |
| 7,335,063 | B2 | 2/2008 | Cohen et al. | |
| 7,371,117 | B2 | 5/2008 | Gailus | |
| 7,381,092 | B2 | 6/2008 | Nakada | |
| 7,682,193 | B2 * | 3/2010 | Stoner | 439/607.07 |
| 7,717,724 | B2 * | 5/2010 | Yu et al. | 439/159 |
| 7,785,148 | B2 * | 8/2010 | Pan | 439/607.06 |
| 2003/0022555 | A1 | 1/2003 | Vicich et al. | |
| 2003/0119362 | A1 * | 6/2003 | Nelson et al. | 439/608 |
| 2003/0220019 | A1 * | 11/2003 | Billman et al. | 439/608 |
| 2010/0144204 | A1 * | 6/2010 | Knaub et al. | 439/607.07 |

* cited by examiner

*Primary Examiner* — Gary F. Paumen

(57) ABSTRACT

An electrical connector system may include multiple wafer assemblies configured to engage with a substrate. A ground strip of the electrical connector system may be coupled with a first wafer assembly and a second wafer assembly. The ground strip is configured to engage with the substrate and provide a common ground potential between the first wafer assembly, the second wafer assembly, and the substrate.

28 Claims, 15 Drawing Sheets

ELECTRICAL CONNECTOR SYSTEM

PRIORITY CLAIM

This application is a continuation-in-part of U.S. patent application Ser. No. 12/474,605 (U.S. Pat. No. 7,819,697), filed May 29, 2009, which claims priority to U.S. Provisional Pat. App. No. 61/200,955, filed Dec. 5, 2008, and claims priority to U.S. Provisional Pat. App. No. 61/205,194, filed Jan. 16, 2009, the entirety of each of these applications is hereby incorporated by reference.

RELATED APPLICATIONS

The present application is related to U.S. patent application Ser. No. 12/474,568, U.S. patent application Ser. No. 12/474,587, U.S. patent application Ser. No. 12/474,605, U.S. patent application Ser. No. 12/474,545, U.S. patent application Ser. No. 12/474,505, U.S. patent application Ser. No. 12/474,772, U.S. patent application Ser. No. 12/474,626, and U.S. patent application Ser. No. 12/474,674, each titled "Electrical Connector System," each filed May 29, 2009, and each claiming priority to U.S. Provisional Pat. App. No. 61/200, 955, filed Dec. 5, 2009 and U.S. Provisional Pat. App. No. 61/205,194, filed Jan. 16, 2009, the entirety of each of these applications is hereby incorporated by reference.

BACKGROUND

Backplane connector systems are typically used to connect a first substrate, such as a printed circuit board, in a parallel or perpendicular relationship with a second substrate, such as another printed circuit board. As the size of electronic components is reduced and electronic components generally become more complex, it is often desirable to fit more components in less space on a circuit board or other substrate. Consequently, it has become desirable to reduce the spacing between electrical terminals within backplane connector systems and to increase the number of electrical terminals housed within backplane connector systems. Accordingly, it is desirable to develop backplane connector systems capable of operating at increased speeds, while also increasing the number of electrical terminals housed within the backplane connector system.

SUMMARY

An electrical connector system may include multiple wafer assemblies configured to engage with a substrate. In one implementation, a ground strip of the electrical connector system may be coupled with a first wafer assembly and a second wafer assembly. The ground strip is configured to engage with the substrate and provide a common ground potential between the first wafer assembly, the second wafer assembly, and the substrate.

In another implementation, an electrical connector system includes a first wafer assembly and a second wafer assembly. The first wafer assembly includes a first signal contact and a second signal contact configured to engage with a substrate. The second wafer assembly includes a first signal contact and a second signal contact configured to engage with the substrate. A ground strip is coupled with the first wafer assembly and the second wafer assembly. The ground strip includes a first mounting contact and a second mounting contact configured to engage with the substrate to provide a common ground potential between the first wafer assembly, the second wafer assembly, and the substrate. The first mounting contact is positioned on the ground strip to at least partially block a line-of-sight between the first signal contact of the first wafer assembly and the second signal contact of the first wafer assembly. The second mounting contact is positioned on the ground strip to at least partially block a line-of-sight between the first signal contact of the second wafer assembly and the second signal contact of the second wafer assembly.

In yet another implementation, a ground strip is provided for an electrical connector system. The ground strip includes means for mechanically and electrically engaging a first wafer assembly, means for mechanically and electrically engaging a second wafer assembly, and means for mechanically and electrically engaging the substrate to provide a common ground potential between the first wafer assembly, the second wafer assembly, and the substrate. The ground strip also includes means for at least partially blocking a line-of-sight between a first signal contact and a second signal contact of the first wafer assembly when the ground strip is engaged with the first wafer assembly.

In a further implementation, an electrical connector system includes a first ground strip coupled with a first wafer assembly and a second wafer assembly. A second ground strip of the electrical connector system is also coupled with the first wafer assembly and the second wafer assembly. A ground shield of the electrical connector system is coupled with the first ground strip and the second ground strip. The ground shield is configured to engage with a substrate to provide a common ground potential between the first ground strip, the second ground strip, and the substrate.

Other systems, methods, features and advantages will be, or will become, apparent to one with skill in the art upon examination of the following figures and detailed description.

DETAILED DESCRIPTION

Figure 1:
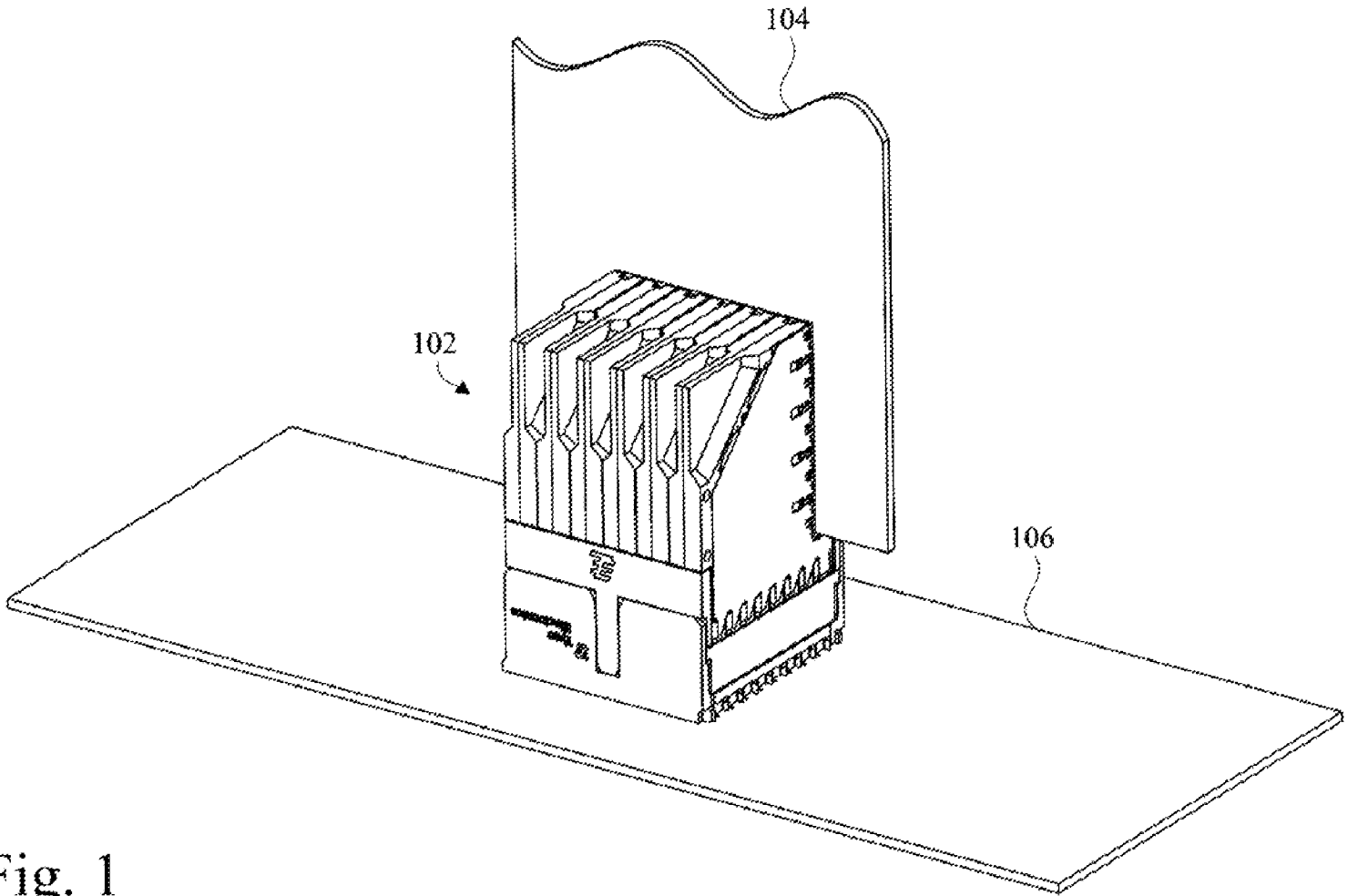
FIG. 1 is a diagram of a backplane connector system connecting a first substrate to a second substrate.

The present disclosure is directed to backplane connector systems that connect with one or more substrates. The backplane connector systems may be capable of operating at high speeds (e.g., up to at least about 25 Gbps), while in some implementations also providing high pin densities (e.g., at least about 50 pairs of electrical connectors per inch). In one implementation, as shown in FIG. 1, a backplane connector system 102 may be used to connect a first substrate 104, such as a printed circuit board, in a parallel or perpendicular relationship with a second substrate 106, such as another printed circuit board. As will be explained in more detail below, implementations of the disclosed connector systems may include ground strips, ground shields, and/or other ground structures that substantially encapsulate electrical connector pairs, which may be differential electrical connector pairs, in a three-dimensional manner throughout a backplane footprint, a backplane connector, and/or a daughtercard footprint. These encapsulating ground strips, ground shields, and/or ground structures, along with a dielectric filler of the differential cavities surrounding the electrical connector pairs themselves, may prevent undesirable propagation of non-traverse, longitudinal, and higher-order modes during operation of the high-speed backplane connector systems.

Figure 2A:
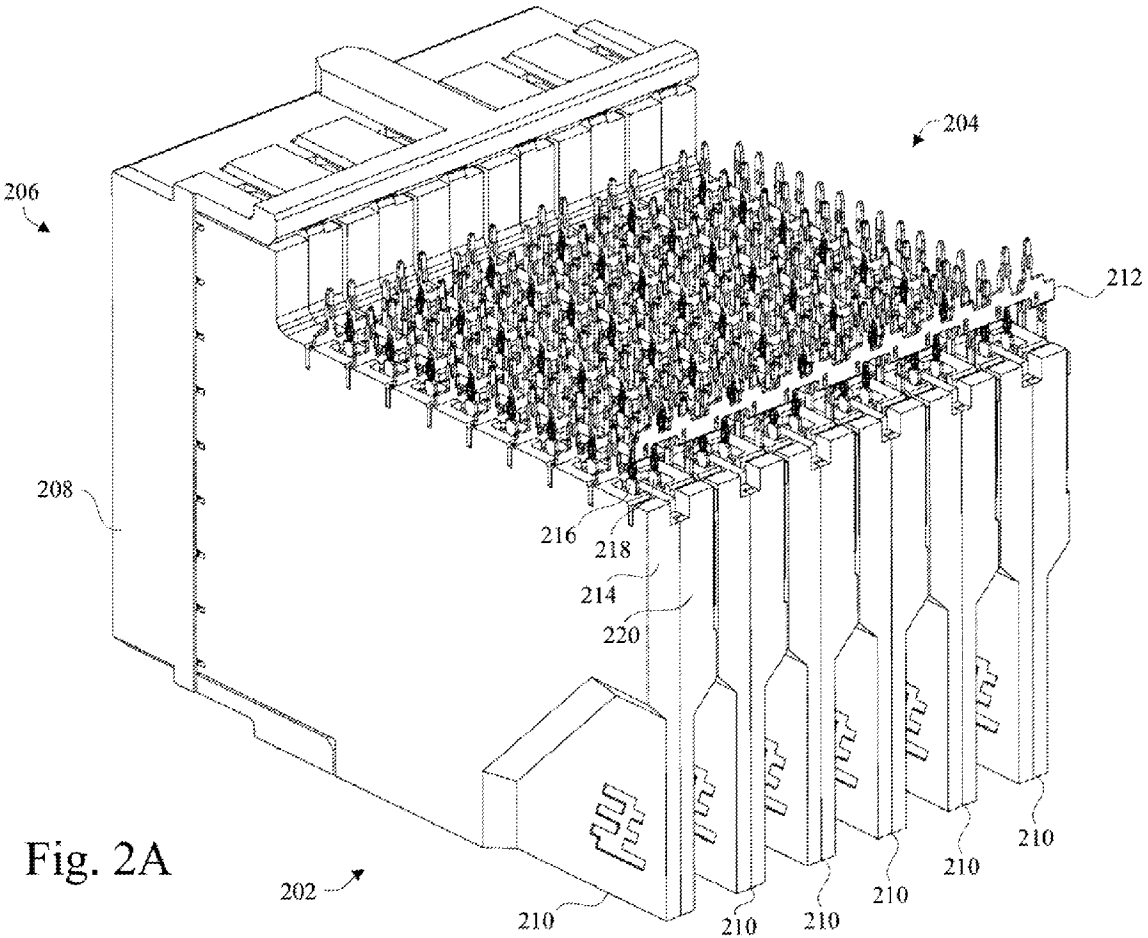
FIG. 2A is a perspective view of an electrical connector system that includes a ground strip.

FIG. 2A is a perspective view of an electrical connector system 202 for connecting multiple substrates. In one implementation, the electrical connector system 202 has a mounting end 204 that connects with a first substrate (e.g., the substrate 104 of FIG. 1) and a mating end 206 that connects with a second substrate (e.g., the substrate 106 of FIG. 1). The first and second substrates may be arranged in a substantially perpendicular relationship when engaged with the electrical connector system 202. The electrical connector system 202 may include a wafer housing 208, one or more wafer assemblies 210, and one or more ground strips 212.

The wafer housing 208 serves to receive and position multiple wafer assemblies 210 adjacent to one another within the electrical connector system 202. In one implementation, the wafer housing 208 engages the wafer assemblies 210 at the mating end 206 of each wafer assembly 210. One or more apertures in the wafer housing 208 are dimensioned to allow mating connectors extending from the wafer assemblies 210 to pass through the wafer housing 208 so that the mating connectors may be connected with corresponding mating connectors associated with a substrate or another mating device, such as the header modules described in U.S. patent application Ser. No. 12/474,568.

Figure 2B:
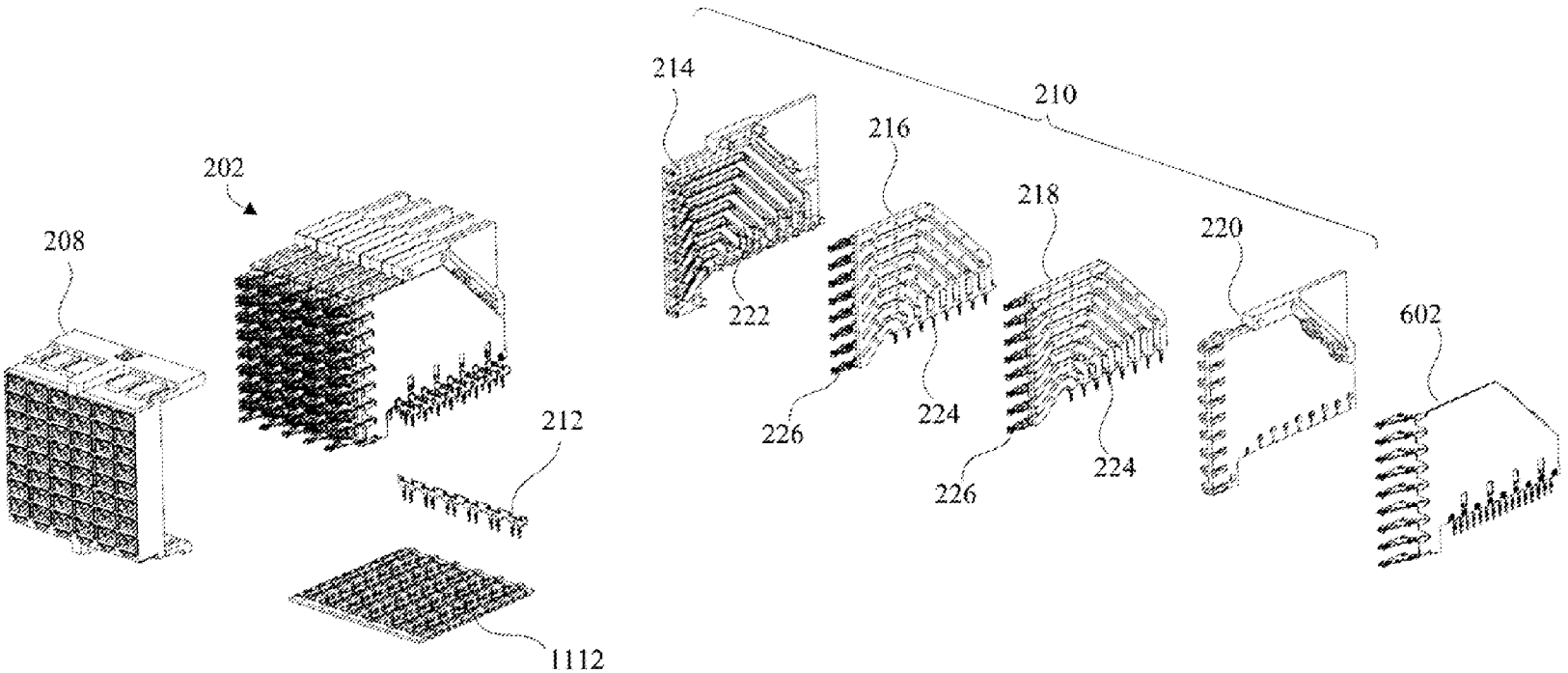
FIG. 2B is a partially exploded view of the electrical connector system of FIG. 2A.

The wafer assemblies 210 serve to provide an array of electrical paths between multiple substrates. The electrical paths may be signal paths, power transmission paths, or ground potential paths. In the implementation shown in FIG. 2A, each wafer assembly 210 includes a first housing 214, a first array of electrical contacts 216 (also known as a first lead frame assembly), a second array of electrical contacts 218 (also known as a second lead frame assembly), and a second housing 220. FIG. 2B shows a partially exploded view of the electrical connector system 202 of FIG. 2A. FIG. 2B also shows a ground shield 602 and an organizer 1102, which will be described below in connection with other figures. FIGS. 2A and 2B illustrate each wafer assembly 210 formed from two outer housings. In other implementations, the wafer assemblies 210 may each include one center housing (e.g., with channels for the two contact arrays formed on each side of the center housing), multiple outer housings, one center housing with multiple outer housings, or other housing configurations.

In the implementation of FIGS. 2A and 2B, the first housing 214 of a wafer assembly 210 includes a conductive surface that defines a plurality of channels 222 dimensioned to receive the first array of electrical contacts 216. In this implementation, the second housing 220 also includes a conductive surface that defines a plurality of channels dimensioned to receive the second array of electrical contacts 218. The channels of the second housing 220 may be substantially similar to the channels 222 illustrated in FIG. 2B. In some implementations, the channels may be lined with an insulation layer, such as an overmolded plastic dielectric, so that when the first and second arrays of electrical contacts 216 and 218 are positioned substantially within their respective channels, the insulation layer electrically isolates the electrical contacts from the conductive surface of the first and second housings 214 and 220. In other implementations, the insulation layer may be applied directly to the arrays of electrical contacts 216 and 218. After the arrays of electrical contacts 216 and 218 have been positioned within the housing components 214 and 218, the housings 214 and 218 are joined together to form the wafer assembly 210.

The arrays of electrical contacts 216 and 218 of the wafer assembly 210 may include a series of substrate engagement elements, such as electrical contact mounting pins 224 shown in FIG. 2B. In one implementation, the substrate engagement elements are signal contacts that mechanically and electrically couple the wafer assemblies 210 with a substrate. When the first and second arrays of electrical contacts 216 and 218 are positioned within the plurality of channels in the housing components 214 and 220, the substrate engagement elements extend away from the mounting end 204 of the wafer assembly 210 to couple with a first substrate. Similarly, mating connectors 226 of the first and second arrays of electrical contacts 216 and 218 extend away from the mating end 206 of the wafer assembly 210 to couple with a second substrate or another mating device, such as a header module. The mating connectors 226 may be closed-band shaped, tri-beam shaped, dual-beam shaped, circular shaped, male, female, hermaphroditic, or another mating connector style.

When the first array of electrical contacts 216 is positioned substantially within the plurality of channels 222 of the first housing 214 and the second array of electrical contacts 218 is positioned substantially within the plurality of channels of the second housing 220, each electrical contact of the first array of electrical contacts 216 may be positioned adjacent to an electrical contact of the second array of electrical contacts 218. In some implementations, the first and second arrays of electrical contacts 216 and 218 are positioned in the plurality of channels such that a distance between adjacent electrical contacts is substantially the same throughout the wafer assembly 210. Together, the adjacent electrical contacts of the first and second arrays of electrical contacts 216 and 218 form a series of electrical contact pairs. In some implementations, the electrical contact pairs may be differential pairs of electrical contacts. For example, the electrical contact pairs may be used for differential signaling.

In some implementations, for each electrical contact pair, the electrical contact of the first array of electrical contacts 216 mirrors the adjacent electrical contact of the second array of electrical contacts 218. Mirroring the electrical contacts of the electrical contact pair may provide advantages in manufacturing as well as column-to-column consistency for high-speed electrical performance, while still providing a unique structure in pairs of two columns.

The first and second housings 214 and 220 of the wafer assembly 210 may be formed to have a conductive surface. For example, the first and second housings 214 and 220 may be formed as plated plastic ground shell housings. In some implementations, each of the first and second housings 214 and 220 comprises a plated plastic or diecast ground wafer, such as tin (Sn) over nickel (Ni) plated or a zinc (Zn) die cast.

In other implementations, the first and second housings 214 and 220 may comprise an aluminum (Al) die cast, a conductive polymer, a metal injection molding, or any other type of metal.

The first and second arrays of electrical contacts 216 and 218 of the wafer assembly 210 may be formed from a conductive material. In some implementations, the first and second arrays of electrical contacts 216 and 218 comprise phosphor bronze and gold (Au) or tin (Sn) over nickel (Ni) plating. In other implementations, the first and second arrays of electrical contacts 216 and 218 may comprise any copper (Cu) alloy material. The platings could be any noble metal such as palladium (Pd) or an alloy such as Pd—Ni or Au flashed Pd in the contact area, tin (Sn) or nickel (Ni) in the mounting area, and nickel (Ni) in the underplating or base plating.

As shown in FIG. 2A, a plurality of ground strips 212 may be positioned to connect with the plurality of wafer assemblies 210 at the mounting end 204 of the electrical connector system 202. Each ground strip 212 may be positioned across the plurality of wafer assemblies 210 so that the ground strip 212 engages each of the wafer assemblies 210. In other implementations, a ground strip may engage with only a subset of the wafer assemblies 210.

The ground strips 212 engage with a substrate and provide a common ground potential between multiple wafer assemblies 210 and the substrate. In some implementations, the housings 214 and 220 of the wafer assemblies 210 may be conductive. For example, the housings 214 and 220 may be formed to have a conductive surface, such as a conductive plating on a plastic housing structure. Therefore, when a ground strip 212 is engaged with multiple wafer assemblies 210 and a substrate, the conductive material of the ground strip 212 serves to provide a common ground potential between the housings of each wafer assembly 210 and the substrate. When a ground strip 212 is engaged with multiple wafer assemblies 210, the ground strip may electrically and mechanically connect with each of the multiple wafer assemblies 210.

Figure 3:
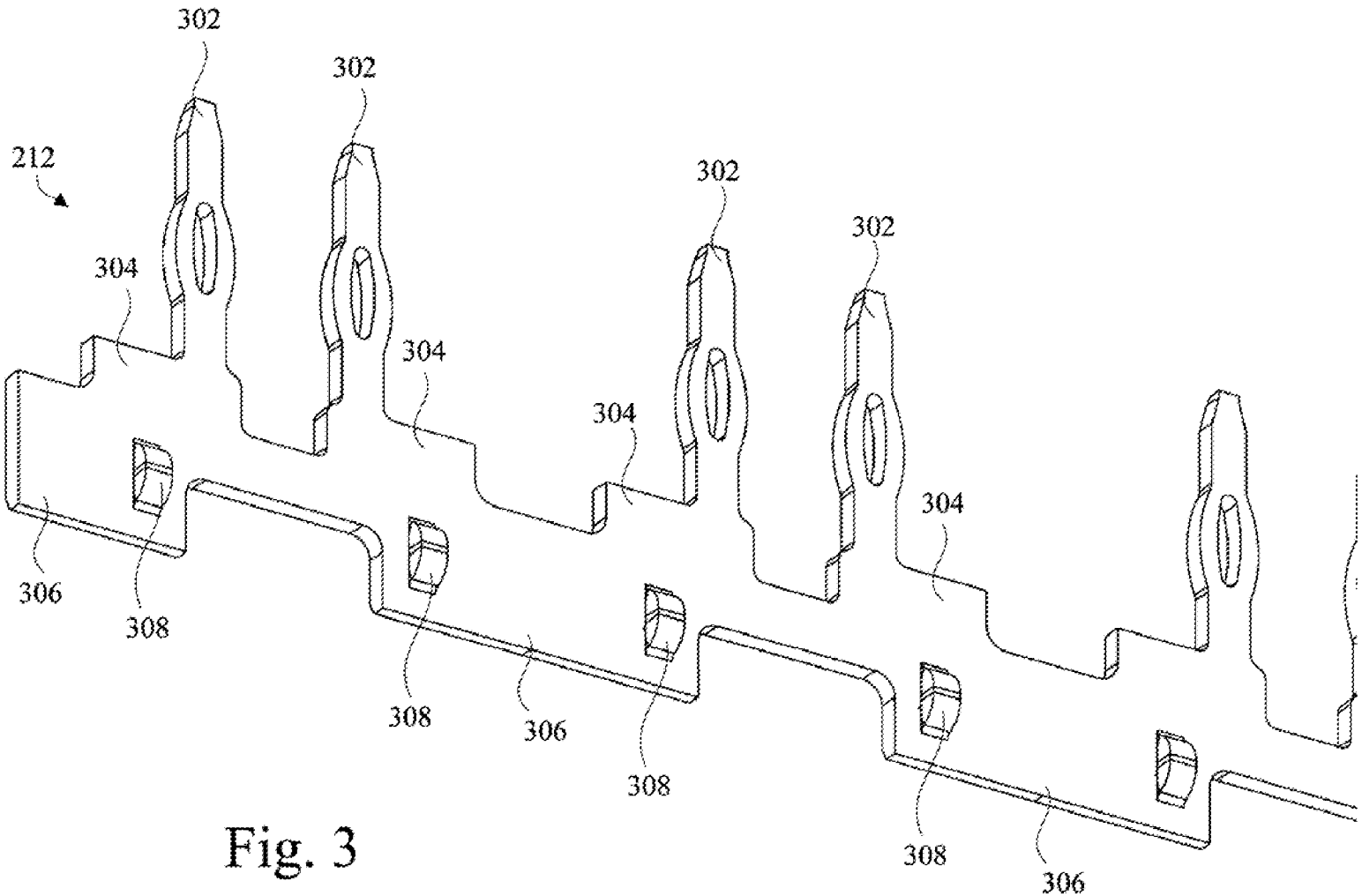
FIG. 3 is a perspective view of one implementation of a ground strip.

FIG. 3 is a perspective view of a ground strip 212. The ground strip 212 of FIG. 3 includes substrate engagement elements 302, shoulder portions 304, base portions 306, and retention components 308. The substrate engagement elements 302 may be mounting contacts, such as ground mounting pins, that mechanically and electrically couple the ground strip 212 with a substrate when the electrical connector system 202 is mounted to the substrate.

Figure 4:
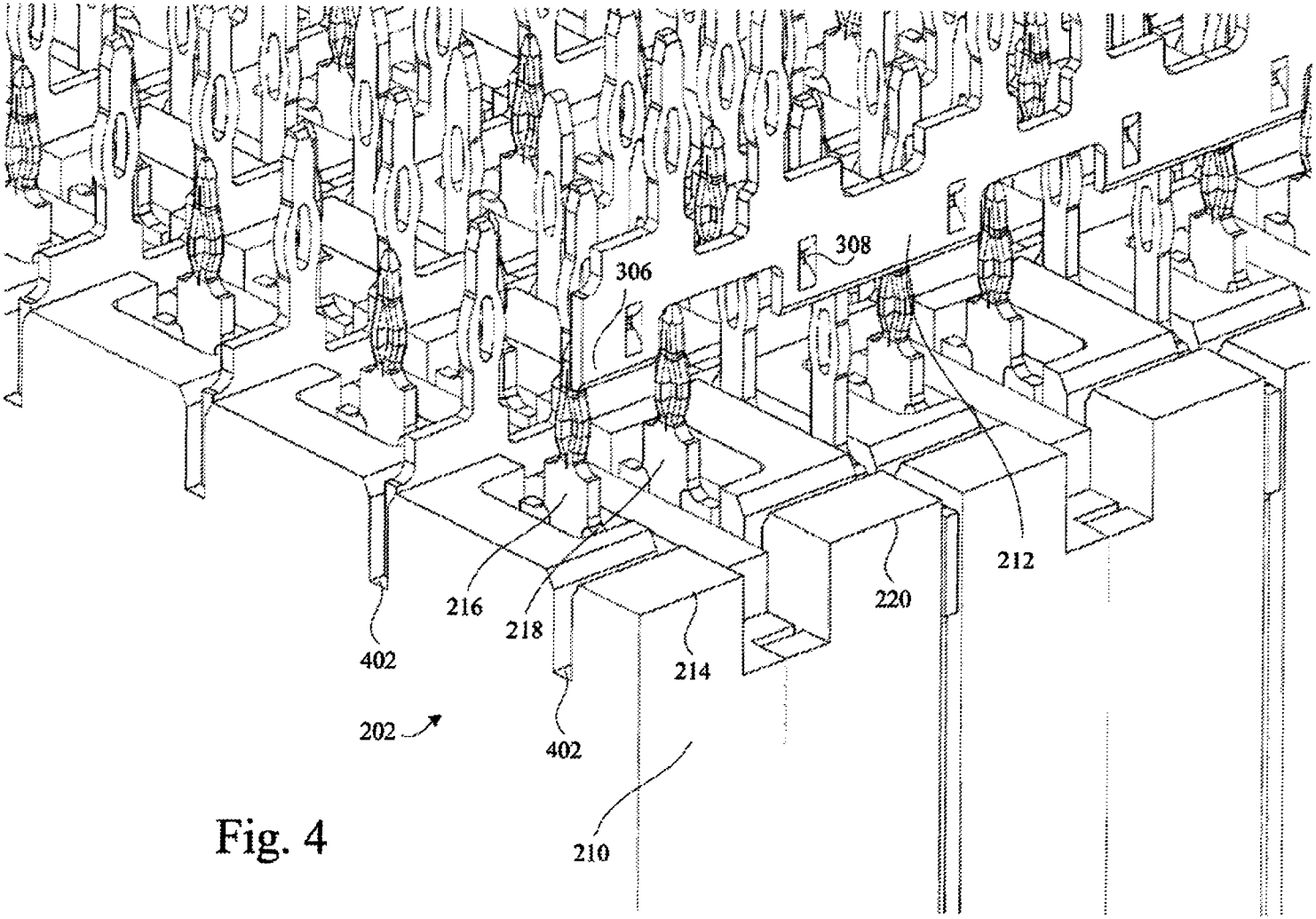
FIG. 4 is an enlarged view of a portion of the electrical connector system of FIG. 2A.
Figure 5:
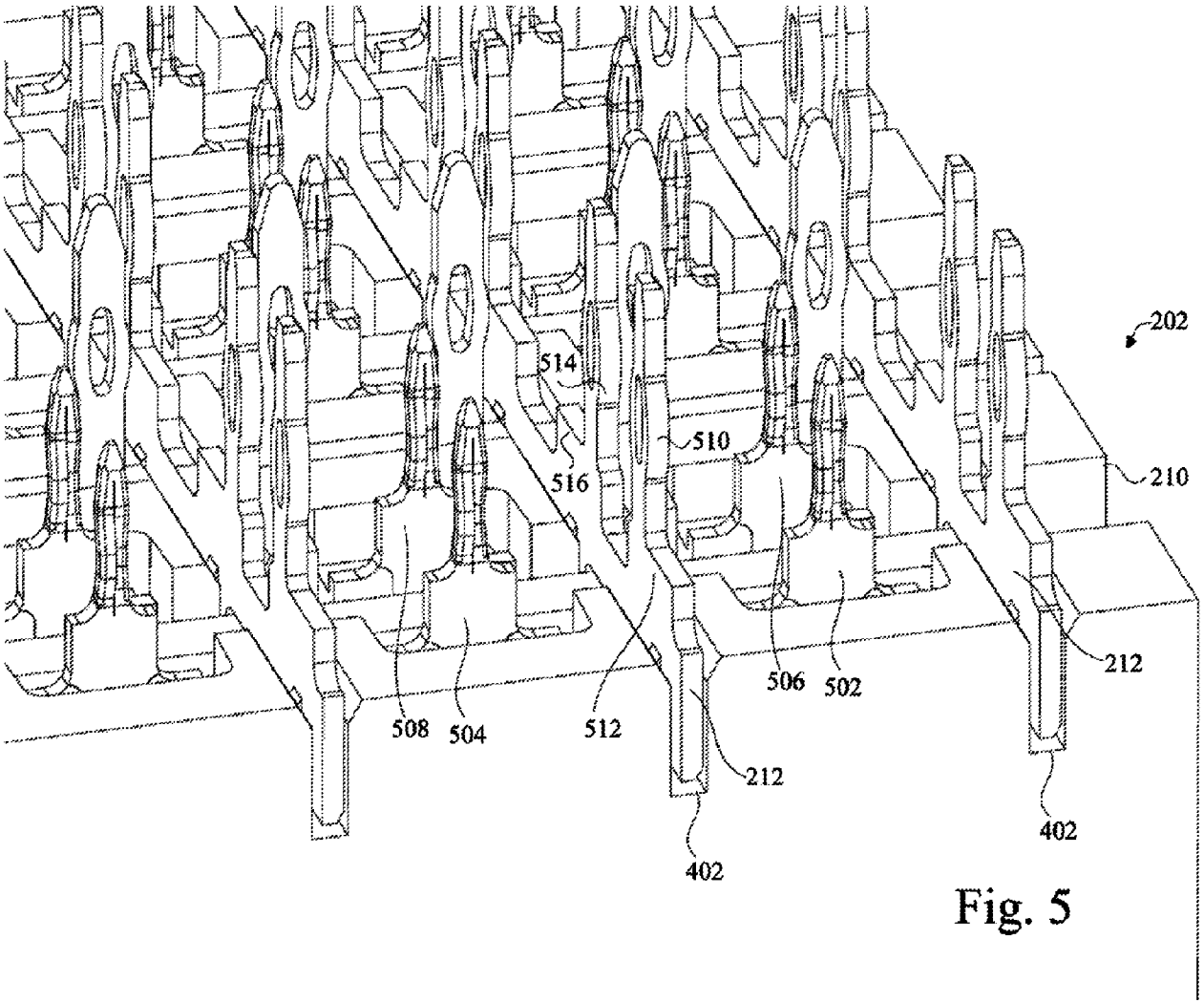
FIG. 5 is another view of a portion of the electrical connector system of FIG. 2A.

FIG. 4 illustrates several ground strips 212 engaged with the plurality of wafer assemblies 210 and one ground strip 212 about to engage with the plurality of wafer assemblies 210. FIG. 5 illustrates a side view of a plurality of ground strips 212 engaged with a plurality of wafer assemblies 210. When multiple ground strips 212 are engaged with the wafer assemblies 210, each ground strip 212 may be aligned in a substantially parallel relationship with the other ground strips 212.

As shown in FIGS. 4 and 5, each of the housings of the wafer assemblies 210 may be formed with a slot 402. The slot 402 in the housing of a first wafer assembly 210 may be aligned with the slot 402 in the housing of an adjacent wafer assembly 210 so that one ground strip 212 may engage with multiple slots 402 in the housings of multiple wafer assemblies 210. When the ground strip 212 is engaged with one or more wafer assemblies 210, the base portions 306 of the ground strip 212 fit within the slots 402 of the wafer assemblies 210. As the ground strip 212 is placed into the slot 402, the retention components 308 create a press fit or interference fit with inner surfaces of the slot 402. For example, the width of the slot 402 is dimensioned to accept and hold the retention components 308 of the ground strip 212. The retention features 308 may be embossed dimple interfaces or other protrusions formed on a surface of the base portions 306 of the ground strip 212. The protrusions may extend out from one or both side faces of the ground strip 212. In other implementations, the ground strips 212 may be connected with the housings of the wafer assemblies 210 by another connection mechanism.

Referring to FIG. 5, some of the ground strips 212 may at least partially block a line-of-sight between signal contacts of the wafer assemblies 210. For example, a portion of the ground strips 212 may at least partially block a direct line path between adjacent signal contacts. By at least partially blocking the direct line path between two signal contacts, the ground strips 212 may help reduce interference propagation between the two signal contacts. For example, the ground strips 212 may reduce crosstalk between adjacent signal contacts. Crosstalk may occur when a signal traveling along a first signal pin interferes with a signal traveling along a second signal pin.

In the implementation of FIG. 5, one wafer assembly 210 may include a plurality of signal contacts extending from the wafer assembly 210. For example, one wafer assembly may include signal contacts 502, 504, 506, and 508. In one implementation, signal contacts 502 and 504 are part of one electrical contact array, and signal contacts 506 and 508 are part of another electrical contact array. In FIG. 5, one of the ground strips 212 is positioned to at least partially isolate some of these signal contacts from each other. For example, the substrate engagement element 510 (and its associated shoulder portion 512) of the ground strip 212 blocks a line-of-sight (e.g., blocks a direct interference propagation path) between the signal contact 502 and the signal contact 504. The substrate engagement element 514 (and its associated shoulder portion 516) of the ground strip 212 is positioned to block a line-of-sight between the signal contact 506 and the signal contact 508.

The ground strip 212 that includes the substrate engagement elements 510 and 514 may also include other substrate engagement elements, as shown in FIG. 5. Those other substrate engagement elements (and their associated shoulder portions) serve to block various lines-of-sight between other adjacent signal contacts of other wafer assemblies. Furthermore, the wafer assembly that includes the signal contacts 502, 504, 506, and 508 may include other signal contacts, as shown in FIG. 5. The electrical connector system 202 may include additional ground strips to block various lines-of-sight between those signal contacts. For example, FIG. 5 shows an additional ground strip 212 that blocks a line-of-sight between the signal contacts 504 and 508 and the adjacent signal contacts to the left of the signal contacts 504 and 508.

Figure 6:
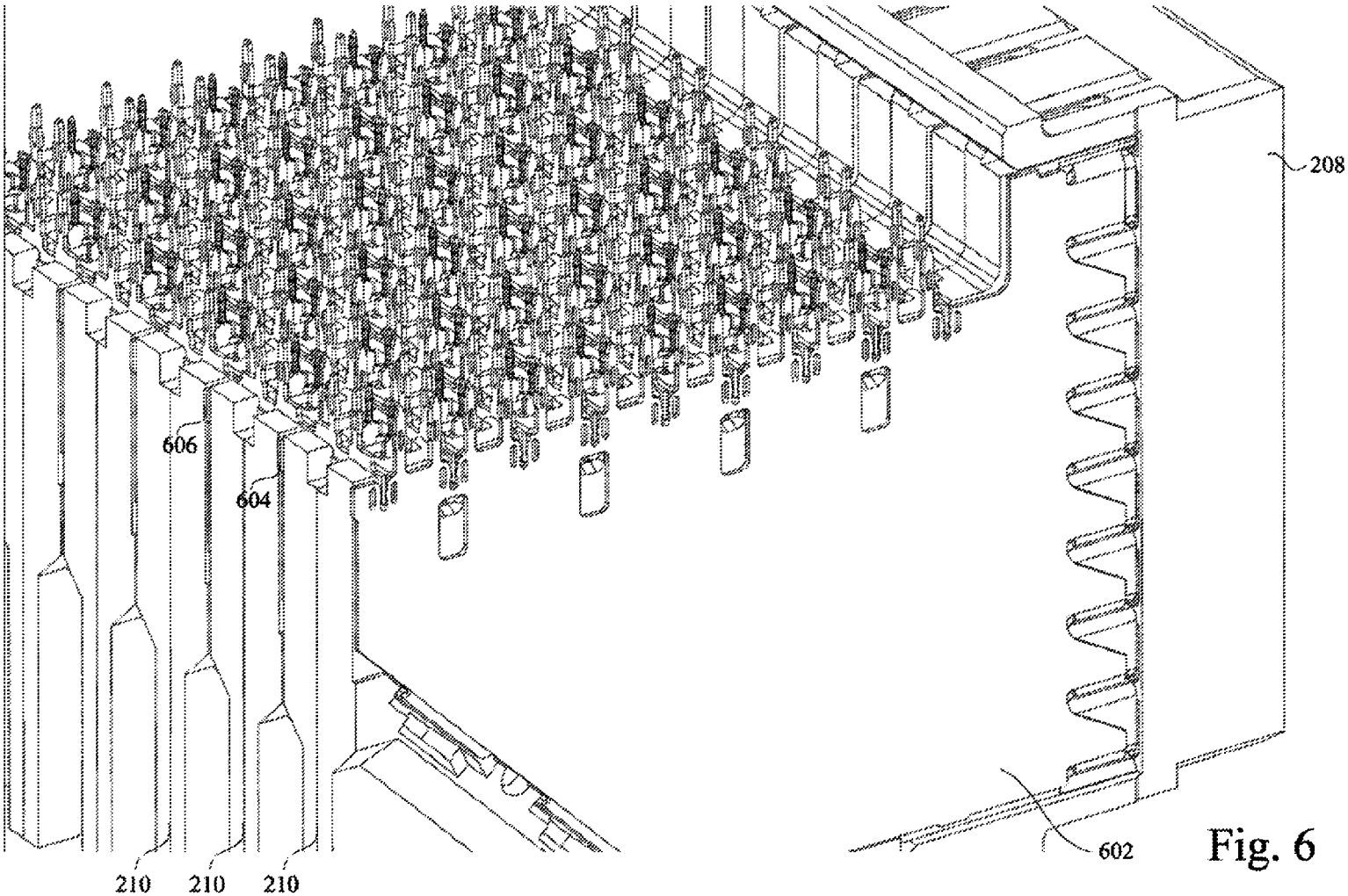
FIG. 6 is a perspective view of an electrical connector system that includes a ground shield.

Some implementations of the electrical connector system 202 may include other ground shielding structures in addition to the ground strips 212. FIG. 6 is a perspective view of an electrical connector system 202 that includes a ground shield 602. As shown in FIG. 6, the ground shield 602 may engage with a side face of one of the wafer assemblies 210. Additional ground shields that are similar or identical to the illustrated ground shield 602 may be positioned between the wafer assemblies 210. Two of these additional ground shields are labeled 604 and 606, although only a small end portion of each of these ground shields is visible in FIG. 6. The ground shield 602 may be disposed on a first side of a first wafer assembly, while the ground shield 604 may be disposed on a second side of the first wafer assembly between the first wafer assembly and a second wafer assembly. The ground shield 606 may then be disposed on the other side of the second wafer assembly.

Figure 7:
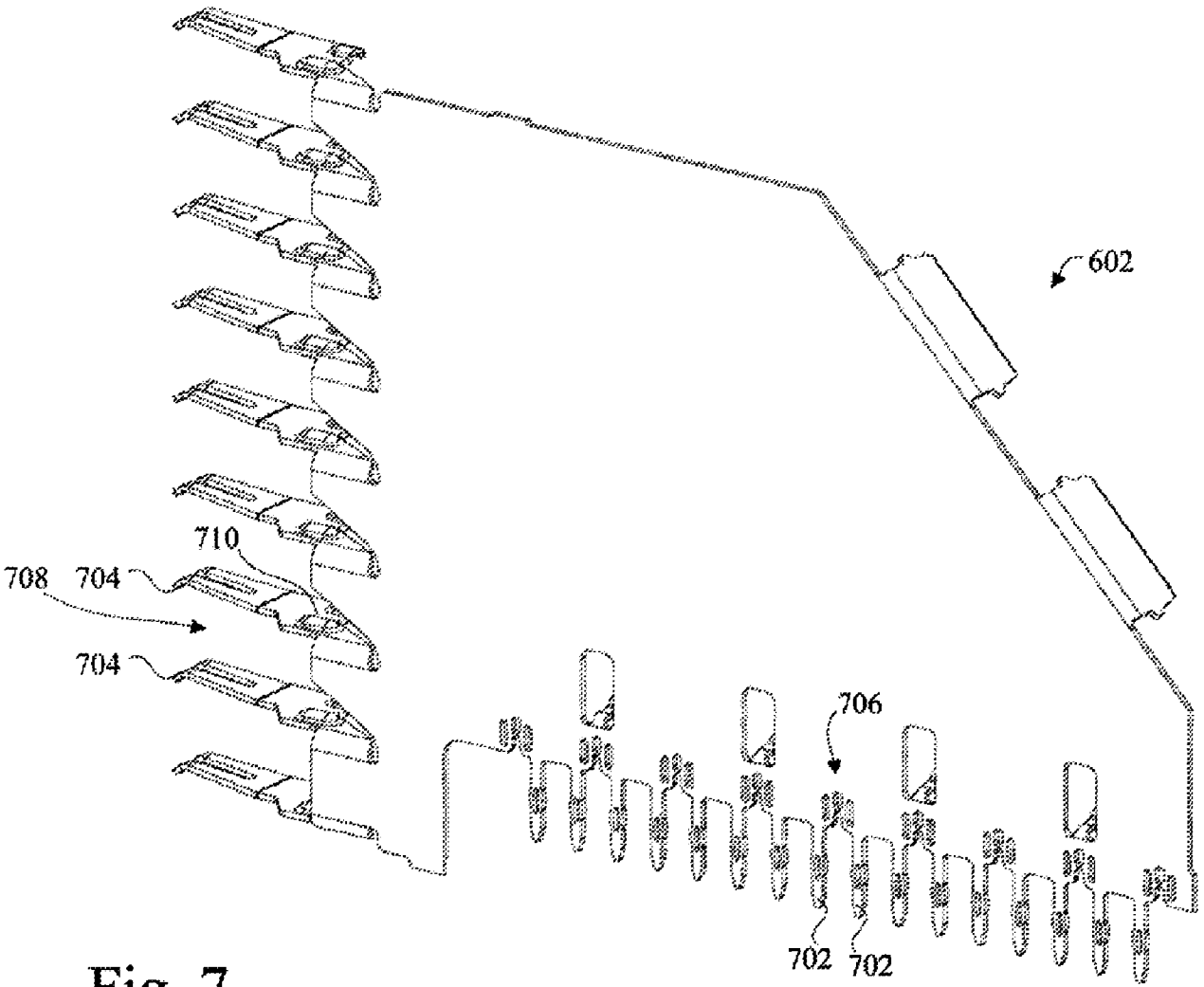
FIG. 7 is a perspective view of one implementation of a ground shield.

FIG. 7 is a perspective view of one implementation of the ground shield 602. The ground shield 602 may include one or more substrate engagement elements 702, one or more ground mating tabs 704, and one or more connection receptacles 706. The substrate engagement elements 702, such as ground mounting pins, are configured to electrically and mechanically connect the ground shield 602 with a substrate.

When the ground shield 602 is engaged with a wafer assembly 210, the ground mating tabs 704 extend away from the mating end 206 of the wafer assembly 210. For example, the ground tabs 704 pass through corresponding apertures in the wafer housing 208. In some implementations, one of the ground mating tabs 704 is positioned above a pair of mating connectors associated with a wafer assembly 210, and another ground mating tab 704 is positioned below the pair. For example, the ground tabs 704 are spaced from each other so that a pair of mating connectors may fit in a space 708 between the adjacent mating tabs 704. In some implementations, the ground mating tabs 704 include one or more mating ribs 710. When the ground shield 602 is engaged with a wafer assembly 210, the mating ribs 710 make contact with the housing of the wafer assembly 210 so that the ground tabs 704 are electrically connected with the conductive housing of the wafer assembly 210.

Figure 8:
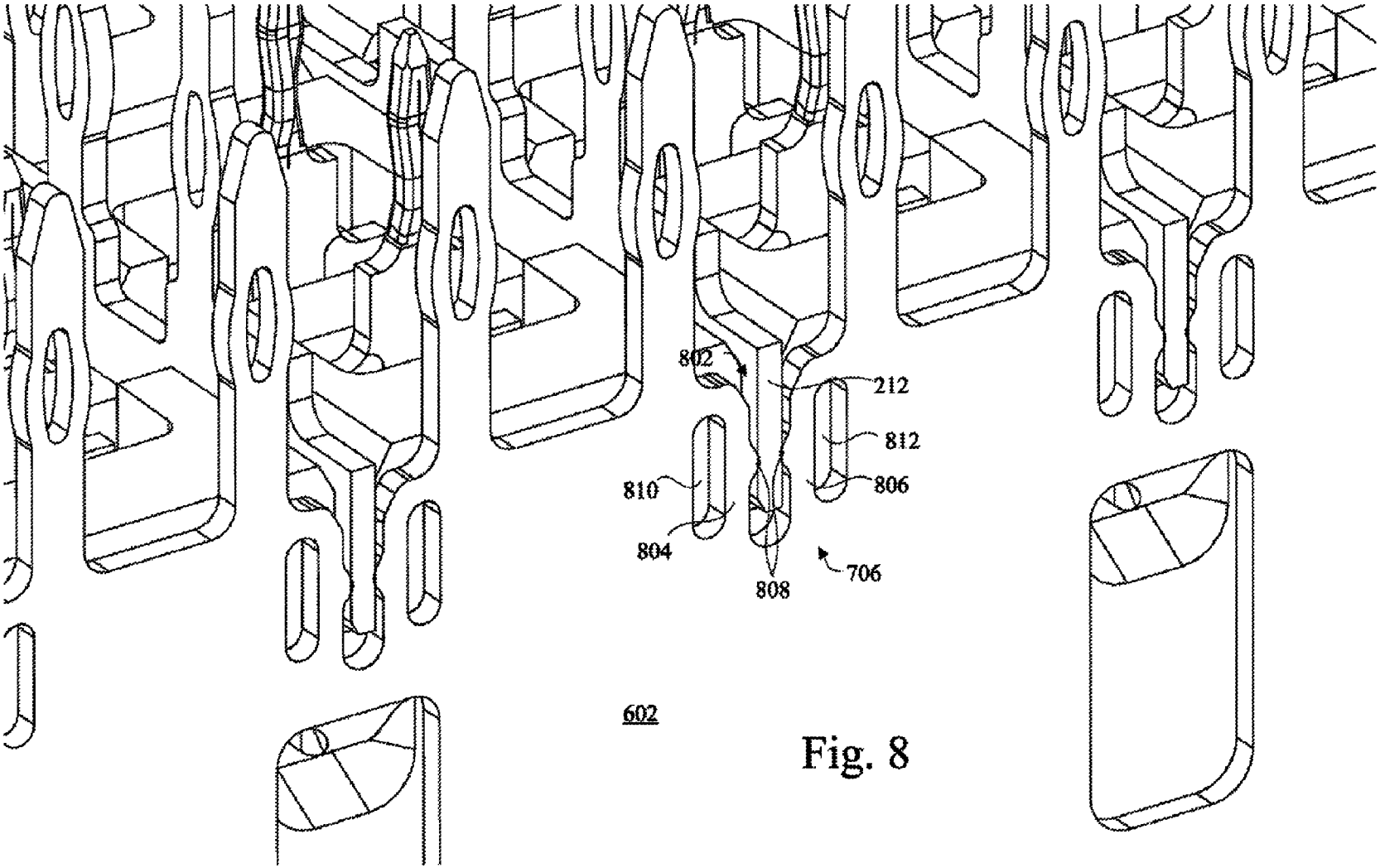
FIG. 8 is an enlarged view of a portion of the electrical connector system of FIG. 6.

The connection receptacles 706 of the ground shield 602 serve to connect with one or more ground strips 212, as shown in FIG. 8. The ground shield 602 may be coupled with multiple ground strips 212 and a substrate to provide a common ground potential between the multiple ground strips 212 and the substrate. When the ground shield 602 is engaged with multiple ground strips 212, the grounds strips 212 may be substantially parallel with each other and substantially perpendicular with the main face portion of the ground shield 602.

The connection receptacles 706 of the ground shield 602 may be dimensioned for a press fit or an interference fit with the ground strips 212. In one implementation, the connection receptacle 706 may include a slot 802 defined by a first strip of material 804, a second strip of material 806, and a pair of protrusions 808 on opposing surfaces of the first and second strips of material 804 and 806. The first strip of material 804 may define a first void 810 in the ground shield 602. Similarly, the second strip of material 806 may define a second void 812 in the ground shield 602. When a ground strip 212 is placed into the slot 802, the ground strip 212 may force a portion of the first strip of material 804 into the first void 810, a portion of the second strip of material 806 into the second void 812, or both. The ground strip 212 may make contact with the pair of protrusions 808 in the slot 802. The slot 802 and the protrusions 808 may be dimensioned to create a press fit or interference fit with the ground strip 212 when the ground strip 212 is engaged with the slot 802. In other implementations, the ground strips 212 may be connected with the ground shield 602 by another connection mechanism.

Figure 9:
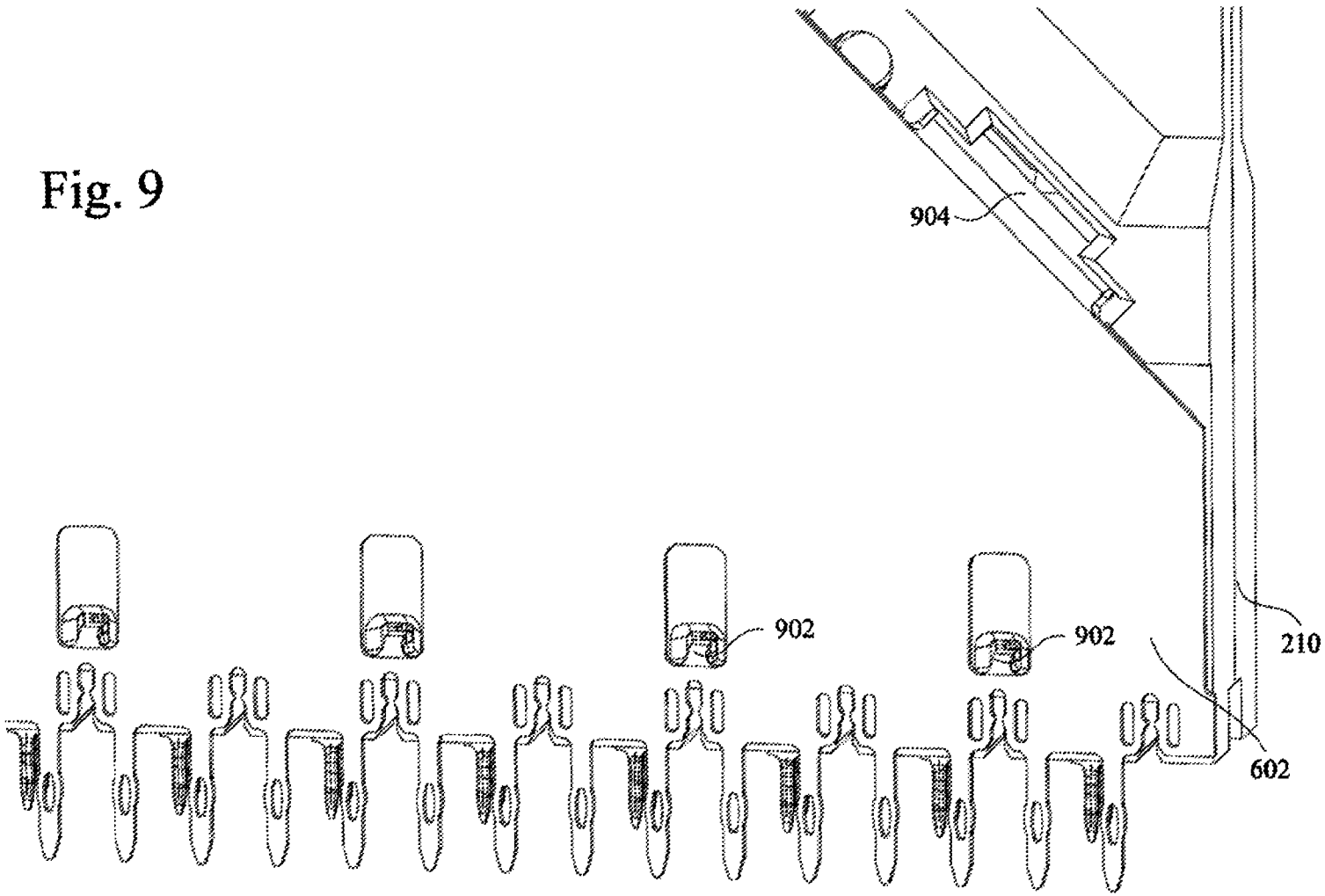
FIG. 9 is another view of a portion of the electrical connector system of FIG. 6.
Figure 10:
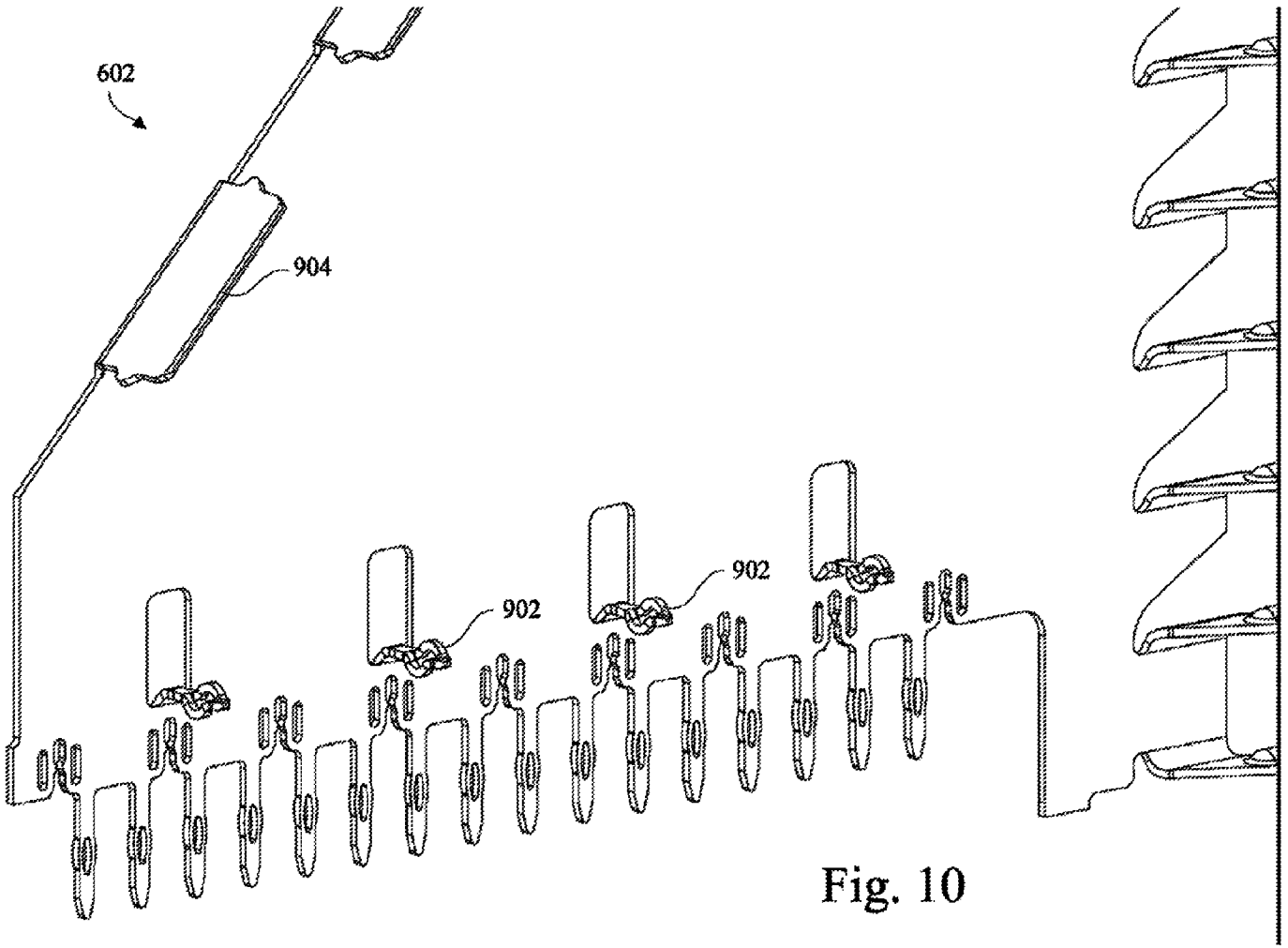
FIG. 10 is another perspective view of the ground shield of FIG. 7.

Referring to FIGS. 9 and 10, the ground shield 602 may include one or more connector components 902 and 904 to couple the ground shield 602 with the housing of a wafer assembly 210. The housing of the wafer assembly 210 may include corresponding features to receive the connector components 902 and 904. For example, the housing of the wafer assembly 210 may include one or more complementary openings to receive the connector component 902 and create a press fit or interference fit. The housing of the wafer assembly 210 may also include one or more slots to receive the connector component 904 of the ground shield. Other implementations may use different engagement mechanisms to connect the ground shields 602 with the wafer assemblies 210.

Figure 11:
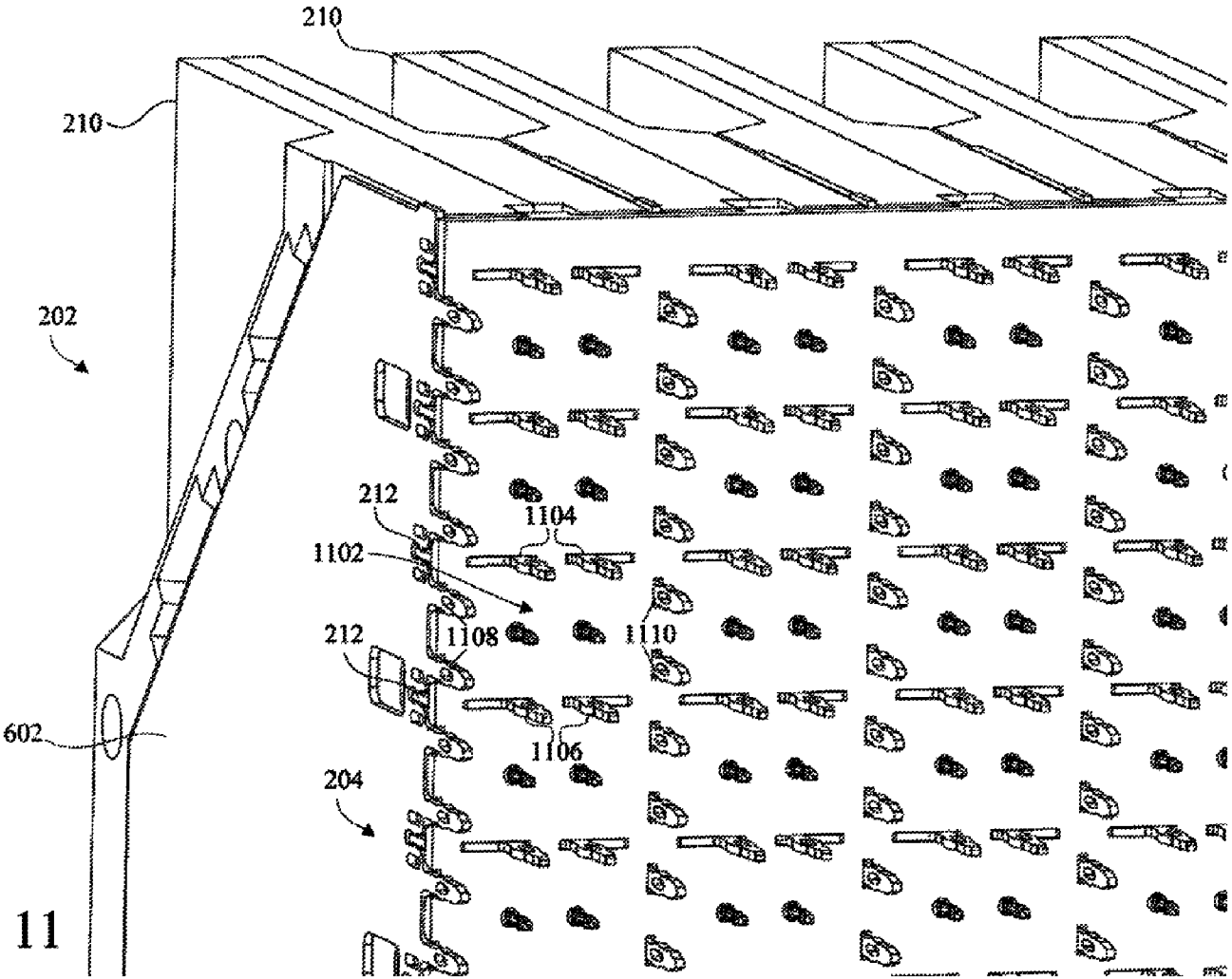
FIG. 11 is a perspective view of an electrical connector system that includes an organizer.

Referring to FIG. 11, the mounting end 204 of the electrical connector system 202 may include multiple ground strips 212 and multiple ground shields 602 that are positioned to substantially encapsulate or shield the electrical connector pairs of the wafer assemblies 210. One electrical connector pair is labelled 1102 and is shown surrounded on each side by ground strips 212 and ground shields 602. Ground mounting pins 1104 of one ground strip 212 may be disposed on a first side (e.g., the top side in the view of FIG. 11) of the electrical connector pair 1102 to provide a ground isolation barrier for the first side of the electrical connector pair 1102. Ground mounting pins 1106 of another ground strip 212 may be disposed on a second side (e.g., the bottom side in the view of FIG. 11) of the electrical connector pair 1102 to provide a ground isolation barrier for the second side of the electrical connector pair 1102. Ground mounting pins 1108 of one ground shield 602 may be disposed on a third side (e.g., the left side in the view of FIG. 11) of the electrical connector pair 1102 to provide a ground isolation barrier for the third side of the electrical connector pair 1102. Lastly, ground mounting pins 1110 of another ground shield 602 may be disposed on a fourth side (e.g., the right side in the view of FIG. 11) of the electrical connector pair 1102 to provide a ground isolation barrier for the fourth side of the electrical connector pair 1102. The ground isolation barriers created by the ground mounting pins 1104, 1106, 1108, and 1110 may prevent crosstalk, interference, or other undesirable propagation of non-traverse, longitudinal, and higher-order modes during operation of the electrical connector system 202. Other pairs of signal contacts may be similarly isolated by the ground strips 212 and the ground shields 602, as shown in FIG. 11.

FIG. 11 shows an electrical connector system 202 that includes an organizer 1112 positioned at the mounting end 204 of a plurality of wafer assemblies 210. The organizer 1112 includes apertures dimensioned to allow electrical contact mounting pins, such as the electrical connector pair 1102 of the wafer assembly 210, to pass through the organizer and connect with a substrate. The organizer 1112 also includes apertures dimensioned to allow the ground mounting pins 1104, 1106, 1108, and 1110 of the ground strips 212 and ground shields 602 to pass through the organizer 1112 and connect with the substrate.

Figure 12:
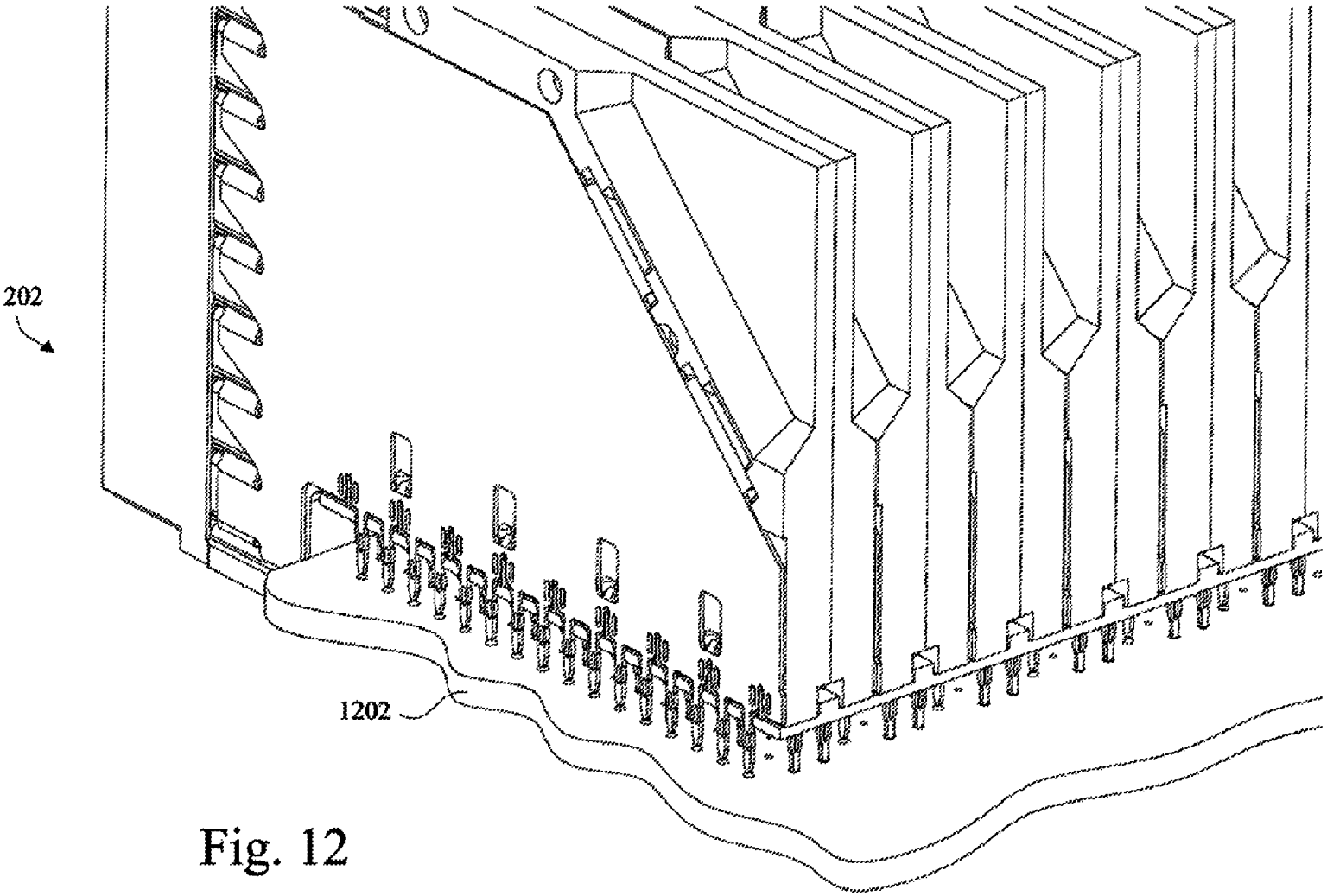
FIG. 12 is a perspective view of an electrical connector system about to engage with a substrate.
Figure 13:
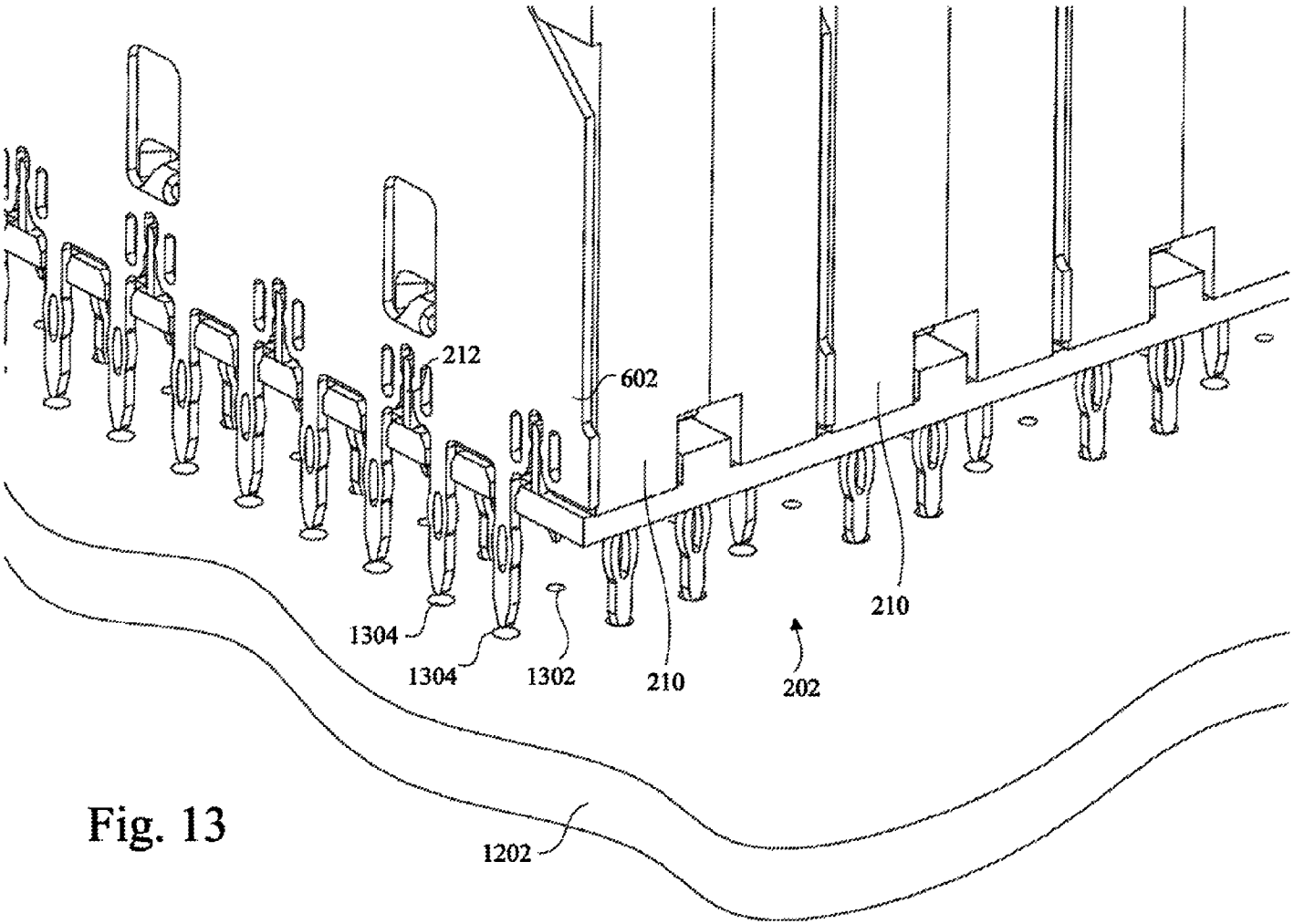
FIG. 13 is an enlarged view of a portion of the electrical connector system of FIG. 12.
Figure 14:
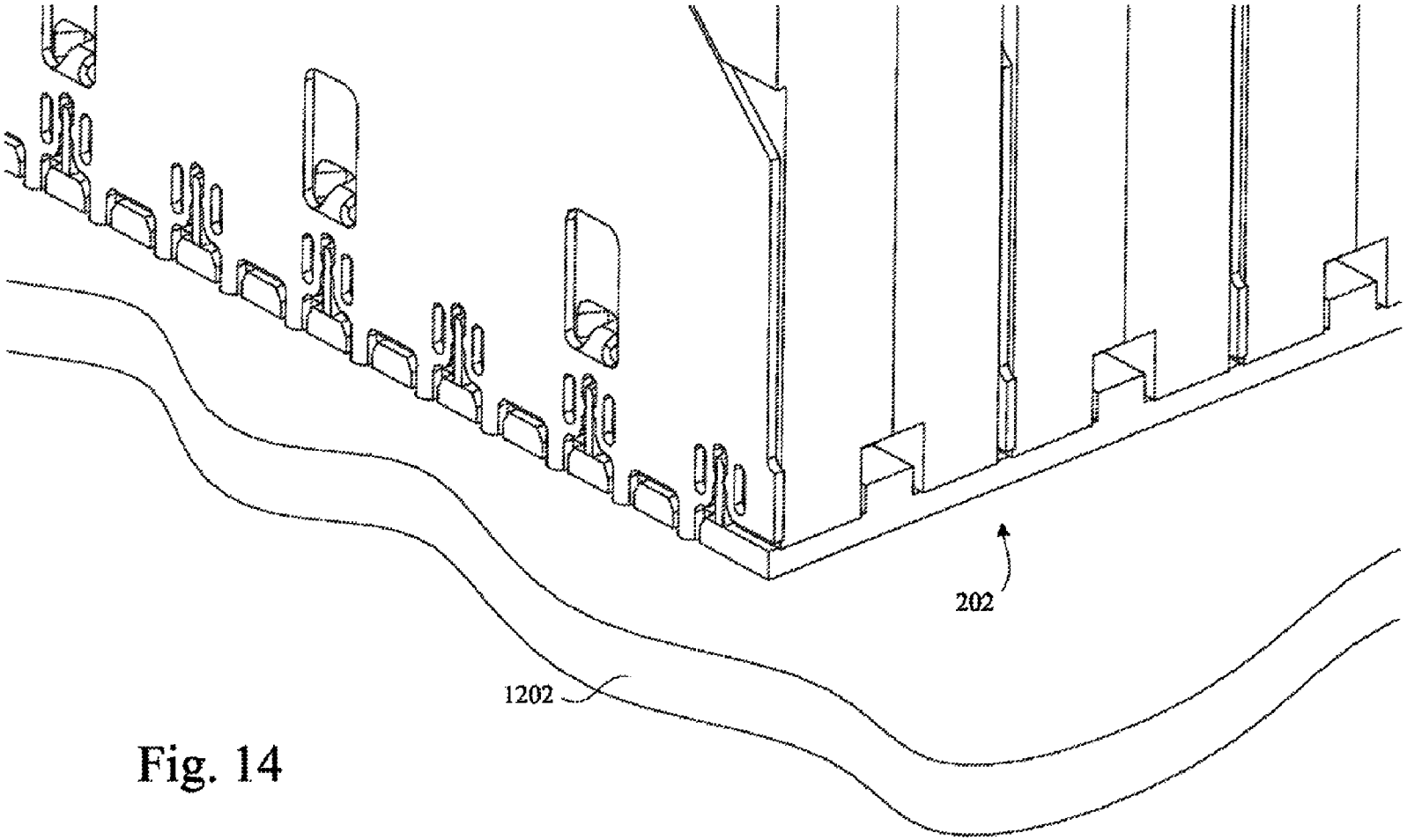
FIG. 14 is a perspective view of the electrical connector system of FIG. 12 after engagement with the substrate.

FIGS. 12 and 13 show the electrical connector system 202 about to connect with a substrate 1202. In some implementations, the substrate 1202 comprises a printed circuit board with multiple signal vias (e.g., via 1302) and multiple ground vias (e.g., vias 1304). The signal vias may mechanically and electrically connect with the signal contacts of the wafer assemblies 210 to couple the wafer assemblies 210 with the substrate 1202. Electrical signals may then pass between the substrate 1202 and the wafer assemblies 210 through the signal contacts. The ground vias may mechanically and electrically connect with ground contacts of the ground strips 212 and the ground shields 602 to couple the ground strips 212 and the ground shields 602 with the substrate 1202. A common ground potential may then be shared between the substrate 1202, the ground strips 212, and the ground shields 602. FIG. 14 illustrates the electrical connector system 202 after engagement with the substrate 1202.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. An electrical connector system, comprising:

a first wafer assembly configured to engage with a substrate;

a second wafer assembly configured to engage with the substrate; and a ground strip coupled with the first wafer assembly and the second wafer assembly, wherein the ground strip is configured to engage with the substrate and provide a common ground potential between the first wafer assembly, the second wafer assembly, and the substrate.

2. The electrical connector system of claim 1, wherein the first wafer assembly comprises a plurality of signal contacts configured to mechanically and electrically couple the first wafer assembly with the substrate.

3. The electrical connector system of claim 2, wherein the ground strip comprises a mounting contact configured to mechanically and electrically couple the ground strip with the substrate.

4. The electrical connector system of claim 2, wherein the ground strip is configured to at least partially block a line-of-sight between a first signal contact of the plurality of signal contacts and a second signal contact of the plurality of signal contacts when the ground strip is coupled with the first wafer assembly;

wherein the first mounting contact is positioned on the ground strip to at least partially block the line-of-sight between the first signal contact and the second signal contact when the ground strip is coupled with the first wafer assembly; and wherein the second mounting contact is positioned on the ground strip to at least partially block a line-of-sight between a third signal contact of the plurality of signal contacts and a fourth signal contact of the plurality of signal contacts when the ground strip is coupled with the first wafer assembly.

5. The electrical connector system of claim 4, wherein the ground strip further comprises a third mounting contact configured to mechanically and electrically couple the ground strip with the substrate; and wherein the third mounting contact is positioned on the ground strip to at least partially block a line-of-sight between a first signal contact of the second wafer assembly and a second signal contact of the second wafer assembly when the ground strip is coupled with the second wafer assembly.

6. The electrical connector system of claim 1, wherein the first wafer assembly comprises a first housing that defines a first slot, wherein the second wafer assembly comprises a second housing that defines a second slot, and wherein the ground strip is configured to engage with the first slot and the second slot to mechanically and electrically connect with the first wafer assembly and the second wafer assembly.

7. The electrical connector system of claim 6, wherein the ground strip comprises a retention component configured to create a press fit or an interference fit with an inner surface of the first slot or the second slot.

8. The electrical connector system of claim 7, wherein the retention component comprises an embossed dimple interface.

9. The electrical connector system of claim 1, wherein the first wafer assembly comprises a first housing having a conductive surface, wherein the second wafer assembly comprises a second housing having a conductive surface, and wherein the ground strip connects with the first and second housings to mechanically and electrically couple with the first and second wafer assemblies.

10. The electrical connector system of claim 1, wherein the first wafer assembly comprises a first plated plastic ground shell housing, wherein the second wafer assembly comprises a second plated plastic ground shell housing, and wherein the ground strip connects with the first and second plated plastic ground shell housings to mechanically and electrically couple with the first and second wafer assemblies.

11. The electrical connector system of claim 1, wherein the substrate comprises a printed circuit board with a first signal via, a second signal via, and a ground via;

wherein the first wafer assembly comprises a signal contact configured to electrically couple the first wafer assembly with the first signal via;

wherein the second wafer assembly comprises a signal contact configured to electrically couple the second wafer assembly with the second signal via; and wherein the ground strip comprises a mounting contact configured to electrically couple the ground strip with the ground via.

12. The electrical connector system of claim 1, wherein the substrate comprises a printed circuit board with a first signal via, a second signal via, and a ground via;

wherein the first wafer assembly comprises a signal contact configured to mechanically and electrically engage with the first signal via;

wherein the second wafer assembly comprises a signal contact configured to mechanically and electrically engage with the second signal via; and wherein the ground strip comprises a mounting contact configured to mechanically and electrically engage with the ground via.

13. The electrical connector system of claim 1, further comprising a ground shield coupled with the ground strip, wherein the ground shield is configured to engage with the substrate to provide a common ground potential between the ground strip and the substrate.

14. An electrical connector system, comprising:

a first wafer assembly with a first signal contact and a second signal contact configured to engage with a substrate;

a second wafer assembly with a first signal contact and a second signal contact configured to engage with the substrate;

a ground strip coupled with the first wafer assembly and the second wafer assembly, wherein the ground strip comprises a first mounting contact and a second mounting contact configured to engage with the substrate to provide a common ground potential between the first wafer assembly, the second wafer assembly, and the substrate; and a ground shield coupled with the ground strip, wherein the ground shield comprises a third mounting contact configured to engage with the substrate to provide a common ground potential between the ground strip and the substrate;

wherein the first mounting contact is positioned on the ground strip to at least partially block a line-of-sight between the first signal contact of the first wafer assembly and the second signal contact of the first wafer assembly, and wherein the second mounting contact is positioned on the ground strip to at least partially block a line-of-sight between the first signal contact of the second wafer assembly and the second signal contact of the second wafer assembly.

15. The electrical connector system of claim 14, further comprising a second ground strip coupled with the first wafer assembly and the second wafer assembly, wherein the ground strip comprises a first mounting contact and a second mounting contact configured to engage with the substrate to provide a common ground potential between the first wafer assembly, the second wafer assembly, and the substrate;

wherein the first wafer assembly comprises a third signal contact configured to engage with the substrate, wherein the second wafer assembly comprises a third signal contact configured to engage with the substrate;

wherein the first mounting contact of the second ground strip is positioned on the second ground strip to at least partially block a line-of-sight between the second signal contact of the first wafer assembly and the third signal contact of the first wafer assembly, and wherein the second mounting contact of the second ground strip is positioned on the second ground strip to at least partially block a line-of-sight between the second signal contact of the second wafer assembly and the third signal contact of the second wafer assembly.

16. The electrical connector system of claim 14, further comprising a plurality of additional ground strips coupled with the first wafer assembly and the second wafer assembly, wherein the ground strip and the plurality of additional ground strips are substantially parallel when coupled with the first and second wafer assemblies.

17. A ground strip for an electrical connector system, comprising:

means for mechanically and electrically engaging a first wafer assembly that comprises a first signal contact and a second signal contact configured to engage with a substrate;

means for mechanically and electrically engaging a second wafer assembly; and means for mechanically and electrically engaging the substrate to provide a common ground potential between the first wafer assembly, the second wafer assembly, and the substrate.

18. The ground strip of claim 17, wherein the means for engaging the first wafer assembly comprises means for creating a press fit or interference fit with a slot in a housing of the first wafer assembly.

19. An electrical connector system, comprising:

a first ground strip coupled with a first wafer assembly and a second wafer assembly;

a second ground strip coupled with the first wafer assembly and the second wafer assembly; and a ground shield coupled with the first ground strip and the second ground strip, wherein the ground shield is configured to engage with a substrate to provide a common ground potential between the first ground strip, the second ground strip, and the substrate.

20. The electrical connector system of claim 19, wherein the first and second ground strips are configured to engage with the substrate to provide a common ground potential between the first wafer assembly, the second wafer assembly, and the substrate.

21. The electrical connector system of claim 19, wherein the first ground strip is substantially parallel to the second ground strip when the first and second ground strips are each mechanically and electrically coupled with the first and second wafer assemblies.

22. The electrical connector system of claim 19, wherein the ground shield is substantially perpendicular to the first and second ground strips when the ground shield is mechanically and electrically coupled with the first and second ground strips.

23. The electrical connector system of claim 19, wherein the ground shield comprises a first connection receptacle configured for a press fit or an interference fit with the first ground strip, and a second connection receptacle configured for a press fit or an interference fit with the second ground strip.

24. The electrical connector system of claim 23, wherein the first connection receptacle comprises a slot defined by a first strip of material, a second strip of material, and a pair of protrusions on opposing surfaces of the first and second strips of material, wherein the first strip of material defines a first void in the ground shield, wherein the second strip of material defines a second void in the ground shield; and wherein the first ground strip forces at least a portion of the first strip of material or the second strip of material into the first void or the second void when the first ground strip makes contact with the pair of protrusions in the slot.

25. The electrical connector system of claim 19, wherein the first and second ground strips mechanically and electrically couple with a plurality of wafer assemblies, the system further comprising a ground shield disposed between each adjacent pair of wafers assemblies of the plurality of wafer assemblies.

26. The electrical connector system of claim 19, wherein the ground shield is disposed on a first side of the first wafer assembly, the system further comprising:

a second ground shield disposed on a second side of the first wafer assembly between the first wafer assembly and the second wafer assembly, wherein the second ground shield is disposed on a first side of the second wafer assembly; and a third ground shield disposed on a second side of the second wafer assembly.

27. The electrical connector system of claim 19, wherein the first ground strip is disposed along a first side of a pair of signal contacts of the first wafer assembly to provide a ground isolation barrier for the first side of the pair of signal contacts;

wherein the second ground strip is disposed along a second side of the pair of signal contacts to provide a ground isolation barrier for the second side of the pair of signal contacts;

wherein the ground shield is disposed along a third side of the pair of signal contacts to provide a ground isolation barrier for the third side of the pair of signal contacts; and the system further comprising a second ground shield disposed along a fourth side of the pair of signal contacts to provide a ground isolation barrier for the fourth side of the pair of signal contacts.

28. The electrical connector system of claim 19, wherein the substrate comprises a printed circuit board with a first ground via, a second ground via, and a third ground via;

wherein the first ground strip comprises a mounting contact configured to mechanically and electrically engage with the first ground via;

wherein the second ground strip comprises a mounting contact configured to mechanically and electrically engage with the second ground via; and wherein the ground shield comprises a mounting contact configured to mechanically and electrically engage with the third ground via.

* * * * *